US008151855B2

(12) United States Patent
Liao

(10) Patent No.: US 8,151,855 B2
(45) Date of Patent: Apr. 10, 2012

(54) DEVICE FOR MANUFACTURING SEAMLESS HAT

(75) Inventor: Sung-Yie Liao, Taichung (TW)

(73) Assignee: Chuan Cheng Hat Co., Ltd., Taichung (TW)

( * ) Notice: Subject to any disclaimer, the term of this patent is extended or adjusted under 35 U.S.C. 154(b) by 1115 days.

(21) Appl. No.: 12/017,368

(22) Filed: Jan. 22, 2008

(65) Prior Publication Data

US 2009/0184140 A1 Jul. 23, 2009

(51) Int. Cl.
*B29C 65/02* (2006.01)
*B29C 65/08* (2006.01)
*B32B 38/04* (2006.01)

(52) U.S. Cl. ..... 156/580.2; 156/580.1; 156/73.1; 156/73.3; 156/250; 156/252; 156/253; 156/256; 156/267; 156/269; 156/499

(58) Field of Classification Search ..... 156/73.1, 156/73.3, 250, 251, 499, 580.1, 580.2, 252, 156/253, 256, 257, 267, 269
See application file for complete search history.

(56) References Cited

U.S. PATENT DOCUMENTS

| | | | | | |
|---|---|---|---|---|---|
| 2,224,370 | A * | 12/1940 | Wescott | ..... | 156/281 |
| 3,443,277 | A * | 5/1969 | Frielingsdorf | ..... | 425/113 |
| 3,994,769 | A * | 11/1976 | Gersbeck | ..... | 156/499 |
| 4,913,772 | A * | 4/1990 | Taylor et al. | ..... | 156/499 |
| 2007/0169873 | A1 * | 7/2007 | Wang | ..... | 156/73.1 |

* cited by examiner

*Primary Examiner* — Mark A Osele
*Assistant Examiner* — Christopher C Caillouet

(57) ABSTRACT

A device for manufacturing a seamless hat includes an assembling cutting device and a layer connecting device. The assembling cutting device includes an ultrasonic metal wheel, an ultrasonic metal platform, a feeding rubber wheel, and a feeding metal wheel. The ultrasonic metal wheel and the feeding rubber wheel are concentric and close to each other. The metal wheel is disposed at the bottom of the feeding rubber wheel. The ultrasonic metal platform is disposed at the bottom of the ultrasonic metal wheel. A top end of a tapered peripheral surface of the ultrasonic metal wheel has a sharp edge and a platform portion, which is disposed at a side away from the rubber wheel. Accordingly, the seam allowance cut pieces of the hat may not be initially connected to the edge of the hat. The assembling cutting device simultaneously proceeds the ultrasonic connection of the seam allowance cut pieces and the residue of the cloth is cut in order that the connection is uniform and to get more efficient.

5 Claims, 7 Drawing Sheets

DEVICE FOR MANUFACTURING SEAMLESS HAT

BACKGROUND OF THE INVENTION

1. Field of the Invention

The present invention generally relates to a device for manufacturing a seamless hat and, more particularly, to a device that provides an assembling cutting device capable of simultaneously connecting a plurality of seam allowance cut pieces and cutting the residue of cloth in order that the width of connection is uniform and to be more efficient.

2. Description of the Prior Art

A prior method for manufacturing a seamless hat is described in detail as below:

(1) a cloth with a content of fiber must be determined at the first stage. Then, a plurality of cut pieces, which are patterned to be with special figures in advance, are overlapped with some edges needed to be machined. Further, the edges and the cut pieces are simply fixed to each other by way of sewing with initial sewing points distributed around the connecting edges.

(2) The overlapped edges of the seam allowance cut piece are melted. Thus, the fiber is melted as well, and the connection is made successfully. Further, the residue will be trimmed off. On one hand, if the trim is too much, a defect product may be generated, such as with a hole, cave, etc. Alternatively, the continuous process will cause bumpiness to the layers.

(3) The processes of the prior method are complicated and not beneficial to an efficient production.

Therefore, how to figure out the disadvantages of the prior arts is an important issue to skilled people in the related field.

SUMMARY OF THE INVENTION

The disadvantages of the prior art are described as below. A cloth with the content of fiber must be determined at the first stage. Then, a plurality of cut pieces, which are patterned to be with special figures in advance, are overlapped with some edges needed to be machined. Further, the edges and the cut pieces are simply fixed to each other by way of sewing with initial sewing points distributed around the connecting edges. As a first conclusion, the initial connection is complicated. Meanwhile, the overlapped edges of the seam allowance cut piece are melted. Thus, the fiber is melted as well, and the connection is then made successfully. Further, the residue will also be trimmed off. However, no matter whether the trimmed portion is too much or too little, the quality of a product will be affected comparatively. As a second conclusion, the processes of the prior method are complicated and not beneficial to an efficient production.

The primary objective of the present invention is to provide a device for manufacturing a seamless hat. The device comprises an assembling cutting device and a layer connecting device. The assembling cutting device comprises an ultrasonic metal wheel, an ultrasonic metal platform, a feeding rubber wheel, and a feeding metal wheel. The ultrasonic metal wheel and the feeding rubber wheel are concentric and close to each other. The feeding metal wheel is disposed at the bottom of the feeding rubber wheel. The ultrasonic metal platform is disposed at the bottom of the ultrasonic metal wheel. A top end of a tapered peripheral surface of the ultrasonic metal wheel has a sharp edge and a platform portion disposed at a side away from the rubber wheel. Accordingly, the seam allowance cut pieces of the hat may not be initially connected to the edge of the hat. Also, the assembling cutting device simultaneously proceeds with the ultrasonic connection of the seam allowance cut pieces and the cutting of the residue of the cloth in order that the connection is uniform and efficient. Lastly, the positions to be connected may be adhered by way of the layer connecting device wrapping around and heating the hot-melt layers in order to manufacture the seamless hat.

With references to the prior art and the present invention, the comparisons are listed as below.

(1) The edges and the cut pieces of the prior art are simply fixed to each other by way of sewing to make initial sewing points distributed around the connecting edges. The present invention has no such initial connection, so that the seamless hat will be manufactured rapidly.

(2) The prior art adopts the way of hot-melt to connect every seam allowance edge. If there is any residue, which must be trimmed off, and no matter whether the trimmed portion is too much or too little, the quality of a product will be affected comparatively. The present invention simultaneously proceeds the connection and the trim so that the width of the connection is uniform.

(3) The steps of the prior art are complicated. The present invention is less complicated and is more efficient.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

The following preferred embodiments and figures will be described in detail so as to approach aforesaid object.

Figure 1:
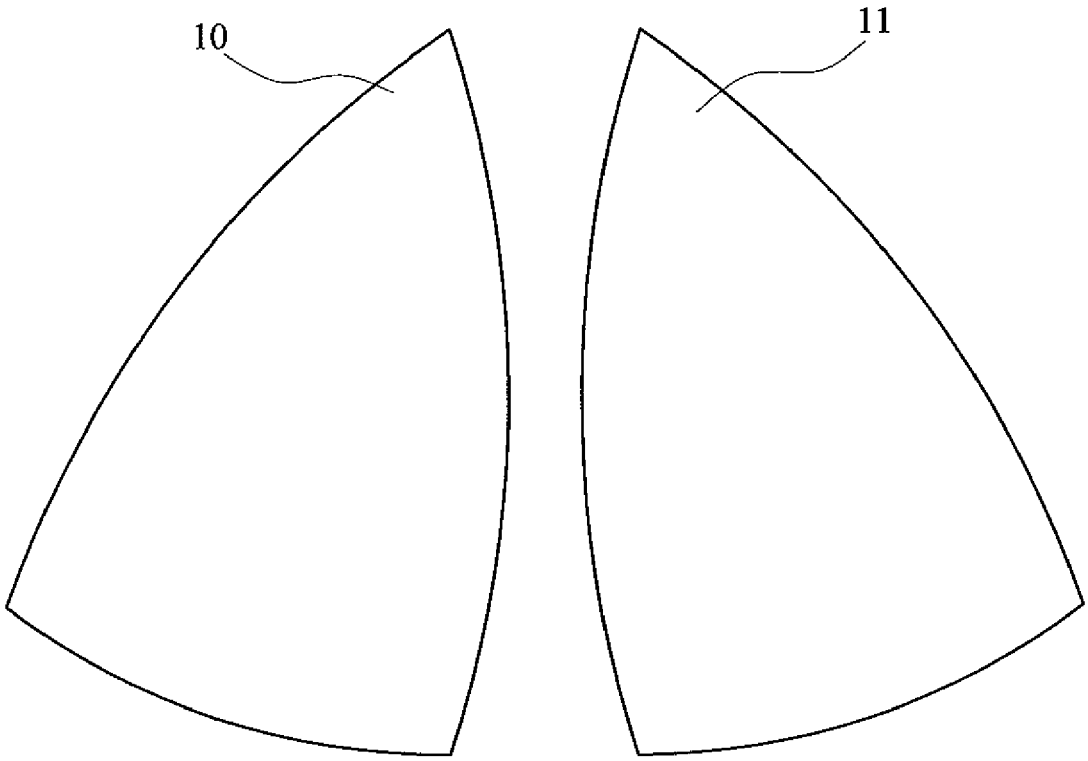
FIG. 1 illustrates a schematic view of two cut pieces of the present invention.

FIG. 1 illustrates a schematic view of two cut pieces of the present invention. The present invention provides a device for manufacturing a seamless hat. First of all, cloth to be welded ultrasonically must be determined. Continuously, the cloth is cut for deserved figures and dimensions to become a plurality of seam allowance cut pieces 10 and 11.

FIG. 2 to FIG. 5 illustrate a schematic side view of an assembling cutting device of the present invention, an amplified schematic view of an ultrasonic metal wheel of the present invention, a schematic view of the seam allowance cut pieces and a cutting state of the present invention, a schematic moving view of a layer connecting device of the present invention, and a schematic 3-D view of a high-temperature ventilator and a low-temperature ventilator of the present invention. The present invention includes: an assembling cutting device 20, which includes an ultrasonic metal wheel 21, an ultrasonic metal platform 22, a feeding rubber wheel 23, and a feeding metal wheel 24. The ultrasonic metal wheel 21 and the feeding rubber wheel 23 are concentric and close to each other. The metal wheel 24 is disposed at the bottom of the feeding rubber wheel 23. The ultrasonic metal platform 22 is disposed at the bottom of the ultrasonic metal wheel 21. A top end of a tapered peripheral surface of the ultrasonic metal wheel 21 has a sharp edge 211 and a platform portion 212, which is disposed at a side away from the rubber wheel 23.

A layer connecting device 30 includes a rubber wheel 31 rolling on a metal wheel 32; a high-temperature ventilator 33; and low-temperature ventilator 34. The two outlets 331 and 341 of the high-temperature ventilator 33 and the low-temperature ventilator 34 both are toward a location between the rubber wheel 31 and the metal wheel 32. A layer roll 40 provides a plurality of layers, with each layer being preheated and adhered onto a seam allowance cut piece connecting line 50. The seam allowance cut piece connecting line 50 is sealed by pressing.

Figure 3:
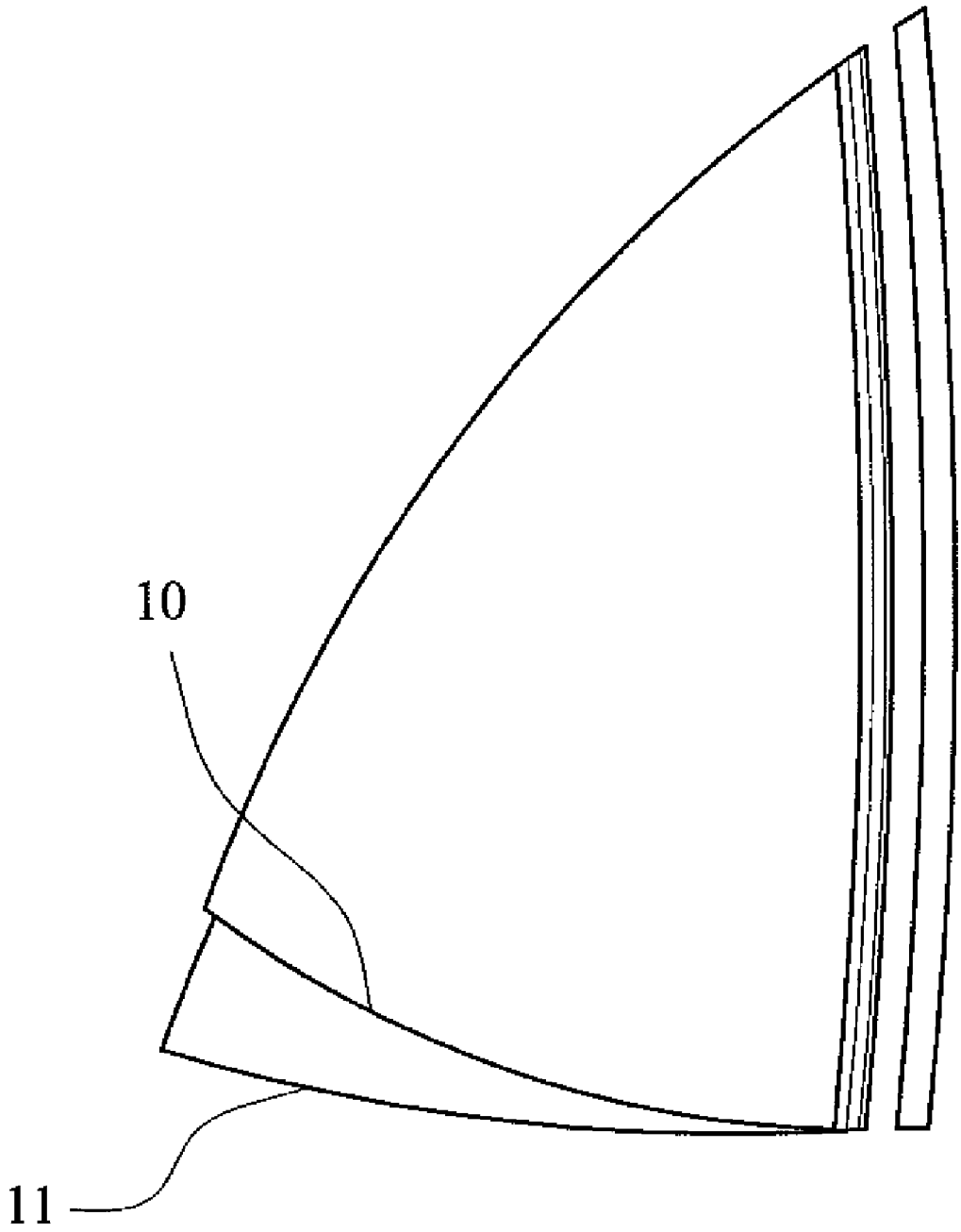
FIG. 3 illustrates a schematic view of seam allowance cut pieces and a cutting state of the present invention.

The platform portion 212 of the ultrasonic metal wheel 21 ultrasonically connects the seam allowance cut pieces 10 and 11. Simultaneously, the sharp edge 211 of the ultrasonic metal wheel 21 cuts off the residue of cloth so that the width of the connection is uniform, as shown in FIG. 3.

The ultrasonic metal platform 22 is shaped as a cylinder, and the central line of the ultrasonic metal platform 22 is vertical to the horizontal central axis line of the ultrasonic metal wheel 21.

The assembling cutting device 20 further has a pressure-adjusting member, which adjusts different pressure values based on different cutting thicknesses as needed to securely cut cloth.

Following the above description, the method for manufacturing the seamless hat includes the steps of: (a) cutting the seam allowance cut pieces: cloth to be welded ultrasonically is determined, and continuously, the cloth is cut for deserved figures and dimensions of the hat to become the plurality of seam allowance cut pieces 10 and 11; (b) using the assembling cutting device to connect and cut: the seam allowance cut piece 10 and the seam allowance cut piece 11 are welded ultrasonically by the platform portion 212 of the ultrasonic metal wheel 21 of the assembling cutting device 20, and the sharp edge 211 cuts the residue of the cloth simultaneously in order that the width of the connection is uniform; (c) adhering by the layer connecting device 30: since hot-melt adhesive is inside the layers, the layers are heated and pressed to fix on the locations of the seam allowance cut pieces for manufacturing the hat by the high-temperature ventilator 33, the low-temperature ventilator 34, the rubber wheel 31, and the metal wheel 32.

The temperature of the high-temperature ventilator 33 is around 280° C. and can be adjusted in the field of temperature based on the properties of cloth. The outlet 331 of the high-temperature ventilator 33 is shaped as a flat and strip tube.

Figure 4:
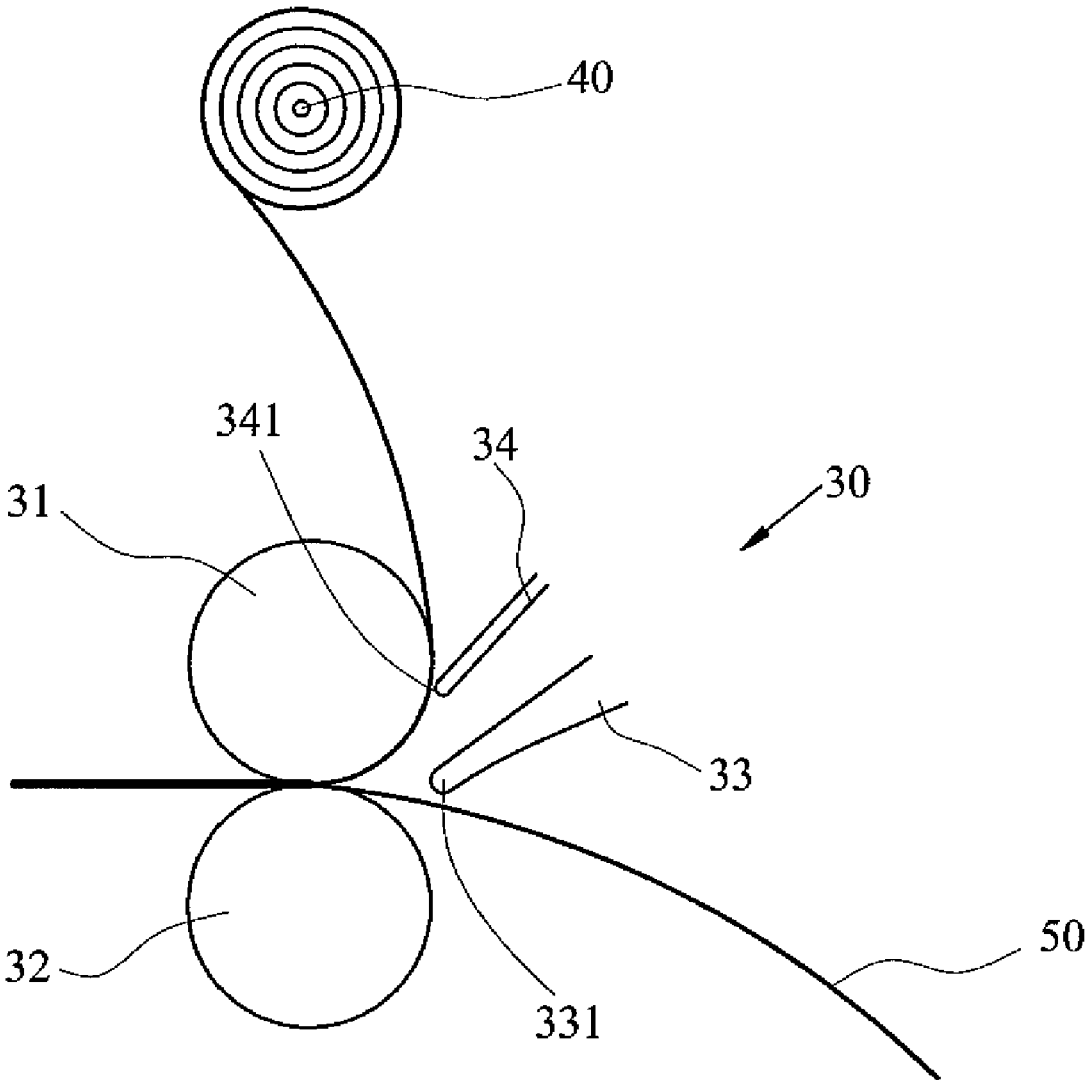
FIG. 4 illustrates a schematic moving view of a layer connecting device of the present invention.
Figure 5:
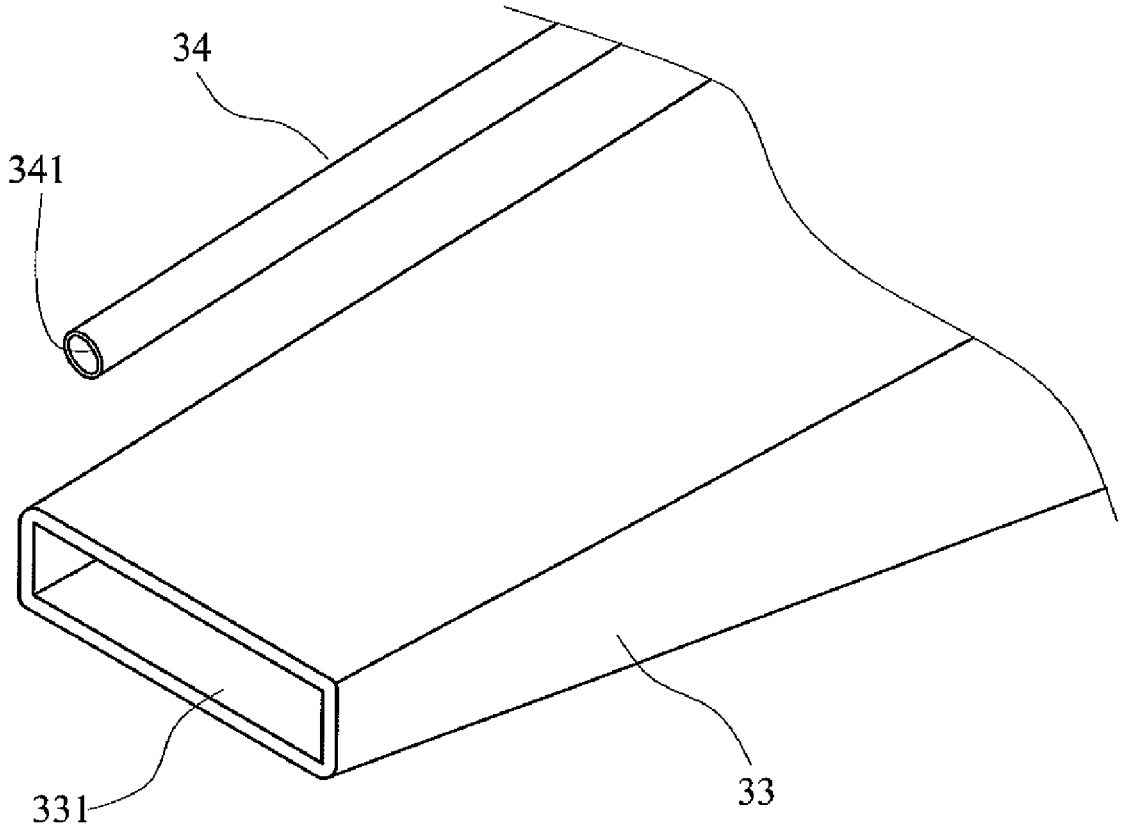
FIG. 5 illustrates a schematic 3-D view of a high-temperature ventilator and a low-temperature ventilator of the present invention.

The low-temperature ventilator 34 is shaped as a round tube and blows air with room temperature to lower the blown air from the high-temperature ventilator 33, as shown in FIG. 4 and FIG. 5

Figure 2:
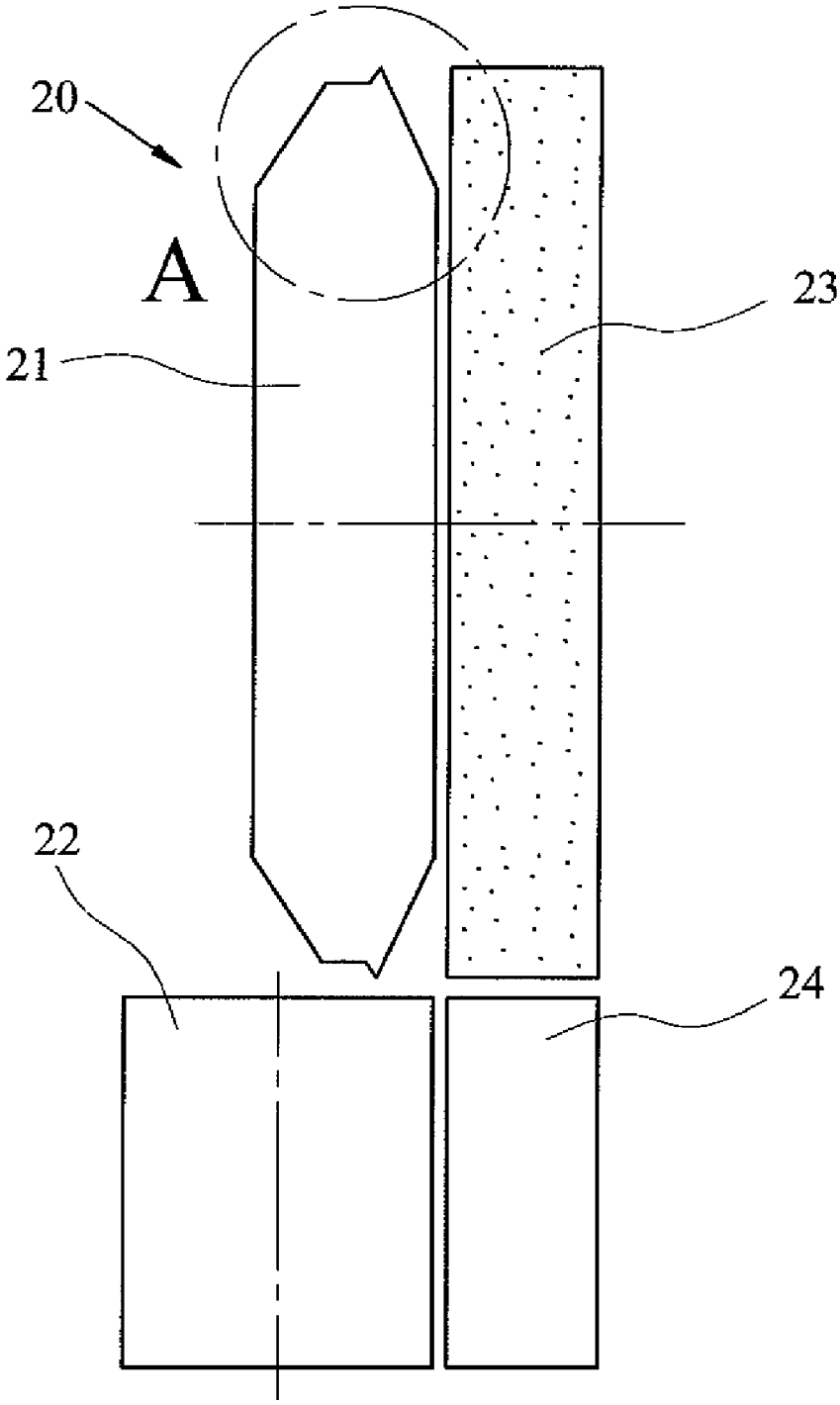
FIG. 2 illustrates a schematic side view of an assembling cutting device of the present invention.
Figure 2A:
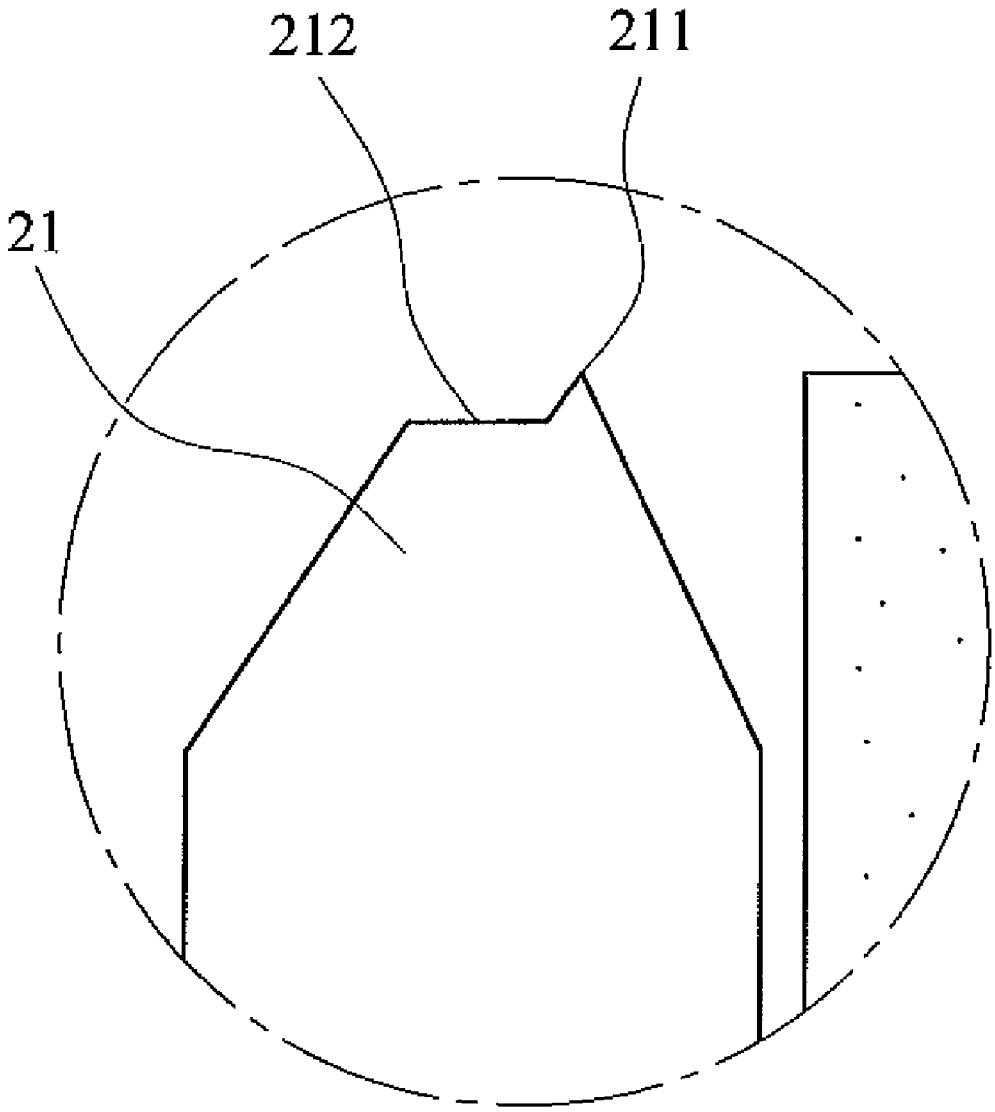
FIG. 2A illustrates an amplified schematic view of an ultrasonic metal wheel of the present invention.
Figure 6:
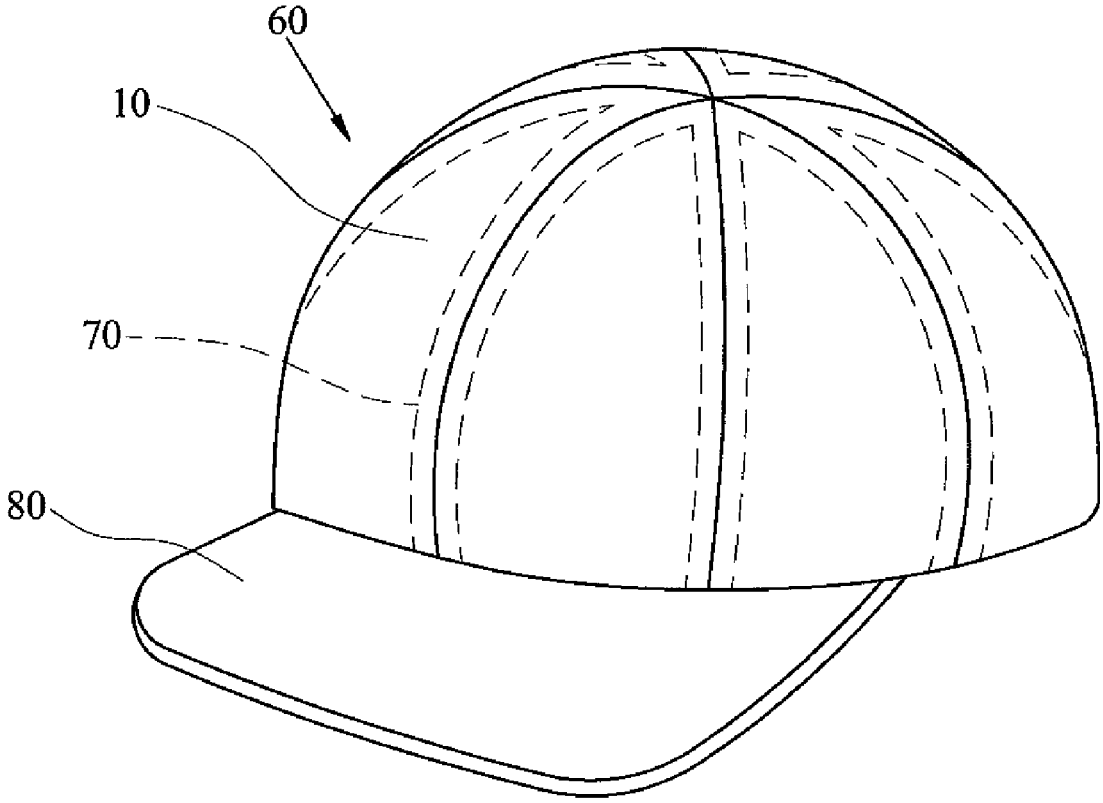
FIG. 6 illustrates a schematic 3-D view of a seamless hat of the present invention.

FIG. 6 illustrates a schematic 3-D view of the seamless hat of the present invention. The plurality of seam allowance cut pieces 10 are combined by the assembling cutting device 20, as shown in FIG. 2, and the residue is cut in order to form a top 60 of the seamless hat. Then, the top 60 is tightly joined together by the layers 70. Thus, a veil 80 is sewn for connecting the top 60 to the seamless hat.

(1) a pre-process for connecting the seam allowance cut pieces may not be necessary to make the whole method more efficient;

(2) The assembling cutting device simultaneously proceeds the ultrasonic connection of the seam allowance cut pieces and the cutting of the residue of the cloth so that the connection is uniform; and (3) by such devices, the purpose of less steps is approached to save cost as well.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A device for manufacturing a seamless hat, comprising:

an assembling cutting device comprising an ultrasonic metal wheel, an ultrasonic metal platform, a feeding rubber wheel, and a feeding metal wheel, wherein the ultrasonic metal wheel and the feeding rubber wheel are concentric and close to each other, with the feeding metal wheel being disposed at a bottom of the feeding rubber wheel, with the ultrasonic metal platform being disposed at a bottom of the ultrasonic metal wheel, with a top end of a tapered peripheral surface of the ultrasonic metal wheel having a sharp edge and a platform portion, with the platform portion disposed at a side of the ultrasonic metal wheel facing away from the feeding rubber wheel, with the assembling cutting device forming a seam allowance cut piece having a connection line; and a layer connecting device comprising: a rubber wheel rolling on a metal wheel; a high-temperature ventilator; a low-temperature ventilator; and a layer roll, with two outlets of the high-temperature ventilator and the low-temperature ventilator both being toward a location between the rubber wheel and the metal wheel; and wherein the layer roll provides a plurality of layers, with each layer being preheated and adhered onto the connecting line of the seam allowance cut piece, with the connecting line of the seam allowance cut piece being sealed by pressing.

2. The device for manufacturing the seamless hat according to claim 1, wherein the ultrasonic metal platform is shaped as a cylinder, and the central line of the ultrasonic metal platform is vertical to a vertical axial line of the ultrasonic metal wheel.

3. The device for manufacturing the seamless hat according to claim 1, wherein the assembling cutting device further has a pressure-adjusting member adjusting different pressure values based on different cutting thicknesses as needed to securely cut the seam allowance cut piece.

4. The device for manufacturing the seamless hat according to claim 1, wherein a temperature of the high-temperature ventilator is around 280° C. and adjustable in the field of temperature based on the properties of the seam allowance cut piece, and wherein the outlet of the high-temperature ventilator is shaped as a flat and strip tube.

5. The device for manufacturing the seamless hat according to claim 1, wherein the low-temperature ventilator is shaped as a round tube and blows air with room temperature to lower the blown air from the high-temperature ventilator.

* * * * *